US006254029B1

(12) United States Patent
Robertson et al.

(10) Patent No.: US 6,254,029 B1
(45) Date of Patent: Jul. 3, 2001

(54) WEED TRIMMER LINE REWINDER DEVICE

(76) Inventors: Judy K. Robertson; Tyler J. Robertson, both of 12295 Cameron Rd., Licking, MO (US) 65542

( * ) Notice: Subject to any disclaimer, the term of this patent is extended or adjusted under 35 U.S.C. 154(b) by 0 days.

(21) Appl. No.: 09/625,354

(22) Filed: Jul. 25, 2000

Related U.S. Application Data

(60) Provisional application No. 60/159,091, filed on Oct. 13, 1999.

(51) Int. Cl.[7] ..... B65H 54/40
(52) U.S. Cl. ..... 242/487; 242/902
(58) Field of Search ..... 242/486.9, 487, 242/902, 546.1

(56) References Cited

U.S. PATENT DOCUMENTS

| | | | | |
|---|---|---|---|---|
| 2,903,196 | | 9/1959 | Fowler . | |
| 3,042,329 | * | 7/1962 | Signorella | 242/487 X |
| 3,175,780 | * | 3/1965 | Nettles | 242/546.1 X |
| 3,647,155 | * | 3/1972 | Jorgenson | 242/902 X |
| 4,717,086 | | 1/1988 | Crow . | |
| 5,163,632 | | 11/1992 | Chilcoat et al. . | |
| 5,370,326 | | 12/1994 | Webb . | |
| 5,636,808 | * | 6/1997 | Colin | 242/546.1 X |
| 5,725,172 | | 3/1998 | Koehler et al. . | |

* cited by examiner

*Primary Examiner*—Michael R. Mansen
(74) *Attorney, Agent, or Firm*—Richard C. Litman

(57) ABSTRACT

A weed trimmer line rewinder device for use by the elderly and those persons having arthritis in the hands. The main work performed by the device rests with a hand crank having a shaft from which extends at least one sliding lug key that can be placed in any location along a track in the shaft so as to be engageable with lugs on various sized spools, including spools for both electric powered and gas powered weed trimmers. A vertically oriented filler string spool axle is on the opposite end of the base board. The filler spool axle has a sharpened top end used to poke through plastic in which the filler spool is wrapped. Midway between the weed trimmer spool and the filler spool is an F-shaped guide peg affixed to the base board. The guide peg provides horizontal guidance and imparts tension upon the weed trimmer string as it is wound around, and replenishes the weed trimmer spool.

10 Claims, 5 Drawing Sheets

WEED TRIMMER LINE REWINDER DEVICE

CROSS-REFERENCE TO RELATED APPLICATION

This application claims the benefit of U.S. Provisional Patent Application Serial No. 60/159,091, filed Oct. 13, 1999.

BACKGROUND OF THE INVENTION

1. Field of the Invention

The present invention relates to weed trimmers and, more specifically, to a weed trimmer line rewinder device.

2. Description of Related Art

A relatively thin string or line is used as the cutting mechanism on the spools of weed trimmers. In operation, as the spool spins, through either gas or electric power, a segment of the line rapidly rotates inside a housing that is open to the ground. The line is usually nylon and somewhat stiff. As a given line segment rotates about the spool, it slashes at and severs plant material, often working against tough weeds. Hence, the line breaks apart fairly rapidly, and each time this happens, a new segment is deployed into the housing. The rotating or dispensing spool on the weed trimmer is removable from the weed trimming machine and is capable of holding fifteen to twenty-five feet of trimmer line. As the line on the weed trimmer spool runs out, it must be replaced with new line from a filler spool. Typically, a filler spool will hold one hundred or more feet of line. It is not difficult for an average adult to replenish the weed trimmer line. But, for those who most often use weed trimmers, i.e., the elderly, it can be a difficult task, particularly for those with arthritic hand conditions. The difficulty relates to gripping a small string with the fingers and winding it in small circles around the weed trimmer spool. The task is made somewhat more difficult by virtue of the fact that the weed trimmer line is somewhat stiff and therefore requires more digital dexterity than other types of string. Moreover, the line can get caught in the lugs of the spool, or it can be placed upon the spool in a manner that is non-uniform, and it can become tangled for any of these reasons. Thus, a device is needed to assist the elderly and those having arthritic conditions, in maintaining their weed trimmers.

The related art discussed below is representative of developments prior to our invention.

U.S. Pat. No. 5,163,632, issued to Chilcoat et al. on Nov. 17, 1992, describes a winder for a monofilament weed cutter. Chilcoat et al. do not teach the present invention as claimed.

U.S. Pat. No. 5,725,172, issued to Koehler et al. on Mar. 10, 1998, describes a fishing reel winding and unwinding device. Koehler et al. do teach the present invention as claimed.

U.S. Pat. No. 2,903,196, issued to H. G. Fowler on Sep. 8, 1959, describes a fishline reel stand. Fowler does not teach the present invention as claimed.

U.S. Pat. No. 4,717,086, issued to J. Q. Crow on Jan. 5, 1988, describes a spool rewinder. Crow does not teach the present invention as claimed.

U.S. Pat. No. 5,370,326, issued to L. A. Webb on Dec. 6, 1994, describes a spool rewinder. Webb does not teach the present invention as claimed.

None of the above inventions and patents, taken either singly or in combination, is seen to describe the instant invention as claimed.

SUMMARY OF THE INVENTION

The present invention is a weed trimmer line rewinder assembly used by the elderly and those having arthritis in the hands. The device includes a horizontally planar base board supporting a solid lubricant disc at one end of the base board. The disc is intended to reduce friction between the board and a weed trimmer spool which is centered, seated upon, and overhangs the lubricant disc.

The main work performed by the present invention rests with a hand crank having a finger knob on a first end, and a weighted second end about which the crank is rotatable. A crank shaft connects the two ends. The shaft has a flat lower side from which extends at least one sliding lug key that can be placed in any location along a track in the shaft so as to be engageable with lugs on various sized spools, including both electric-powered, and gas-powered weed trimmer spools.

A vertically oriented filler string spool axle is on the opposite end of the base board. The filler spool axle has a bottom end and, for convenience, a sharpened top end used to poke through plastic in which the filler spool is typically wrapped.

Midway between the weed trimmer spool and the filler spool is an F-shaped guide peg affixed to the base board. The guide peg provides horizontal guidance and imparts tension upon the weed trimmer string as it is wound around and replenishes the weed trimmer spool.

Accordingly, it is a principal object of the invention to provide a lightweight, simple, and compact device for rewinding the spool of a gas-powered or electric-powered weed trimmer.

It is another object of the invention to provide a weed trimmer line rewinder device that can be readily used by the elderly, or by those having severe arthritic conditions of the hand, and for whom the seemingly simple task of winding a string around a spool is very difficult.

It is a further object of the invention to provide a device that will place a line on a spool uniformly and without tangles.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
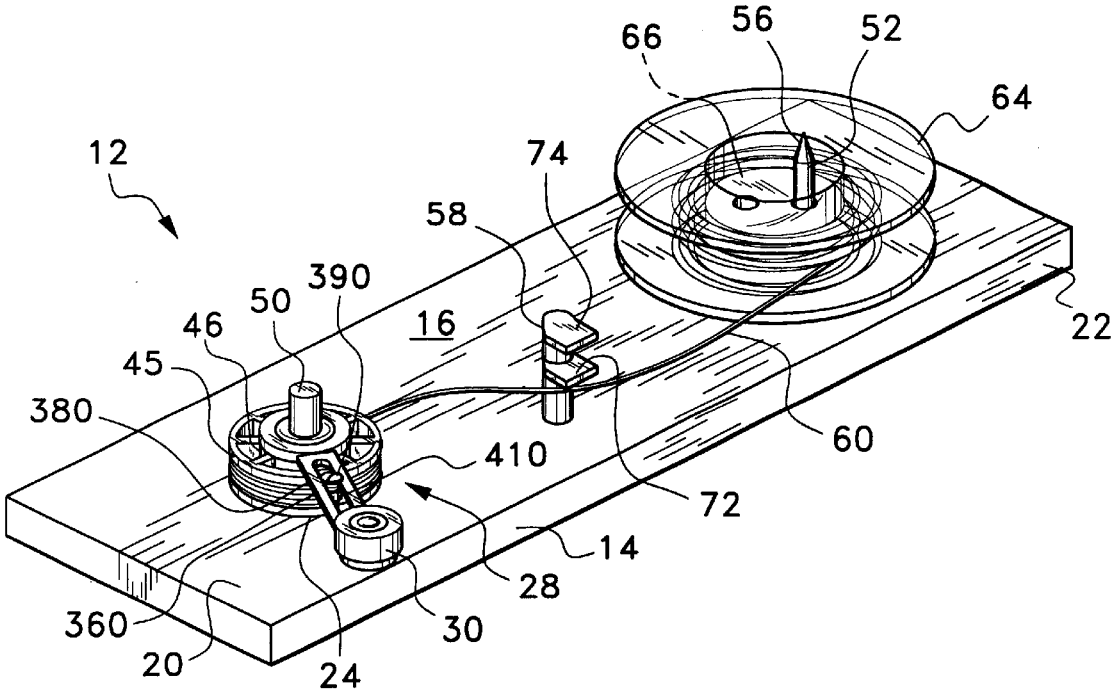
FIG. 1 is an environmental, perspective view of a weed trimmer line rewinder device according to the present invention.
Figure 2:
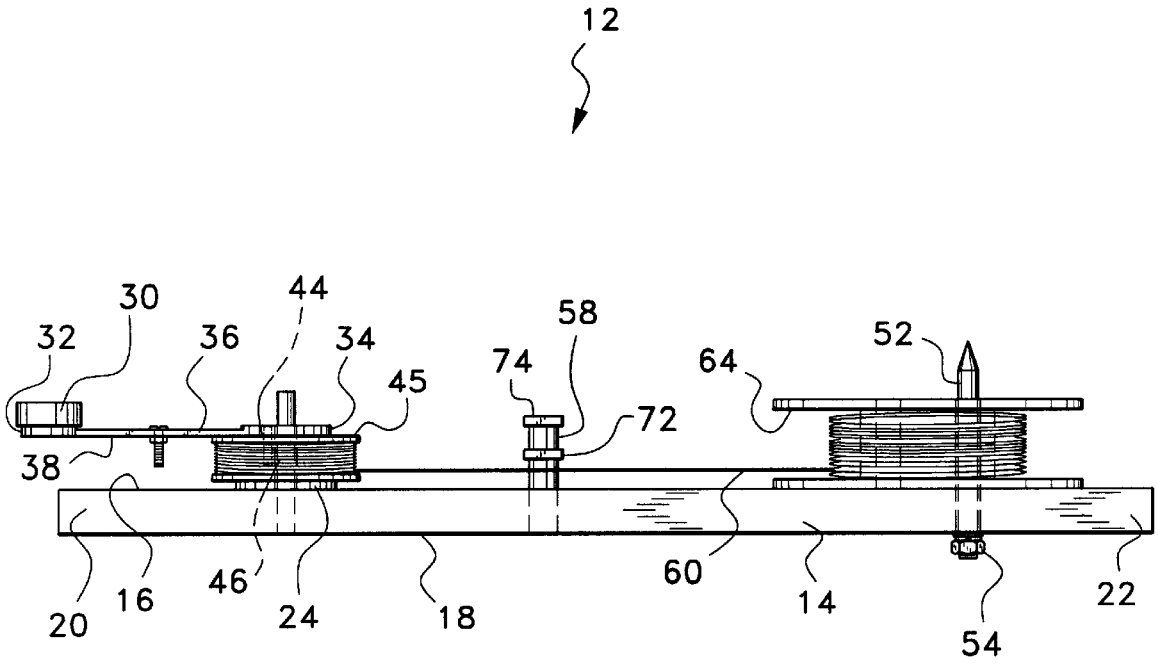
FIG. 2 is a side view of the line rewinder device for a standard electric weed trimmer.

As best shown in FIG. 1, the present invention is a weed trimmer line rewinder assembly 12, comprising a horizontally planar base board 14 having a top surface 16, a bottom surface 18, a left end 20, and a right end 22. As distinctly shown in FIGS. 4 and 5, a solid lubricant disc 24, preferably plastic, but it could also be graphite, teflon, or the like, is horizontally affixed, preferably glued, to a portion of the top surface 16 proximate the left end 20. Disc 24 is intended to reduce friction between board 14 and a weed trimmer spool 41 (FIGS. 3 and 5), 45. Spools 41, 45 are centered, seated upon, and overhang lubricant disc 24.

As shown in the preferred embodiment of FIG. 1, a horizontally disposed hand crank 28 comprises a finger knob 30 on the upper side of a first end 32, a weighted second end 34 about which crank 28 is rotatable, and a crank shaft 360 connecting first end 32 to second end 34. Shaft 360 has a flat lower side 380 from which extends one sliding lug key 390. The preferred embodiment of FIG. 1 discloses a single lug key 390 that can be placed in any location along track 410 so as to be engageable with lugs on various sized weed trimmer spools.

FIGS. 2 through 5 show an alternate embodiment where shaft 36 has two stationary lug keys on the lower side 38 of shaft 36. FIGS. 1 through 5 are identical in every other respect, that is, besides the lug key(s) and crank shaft. The only other variation in the drawings is the best shown in FIGS. 4 and 5, which show are electric-powered weed trimmer spool 45, and gas-powered weed trimmer spool 41, respectively.

Figure 3:
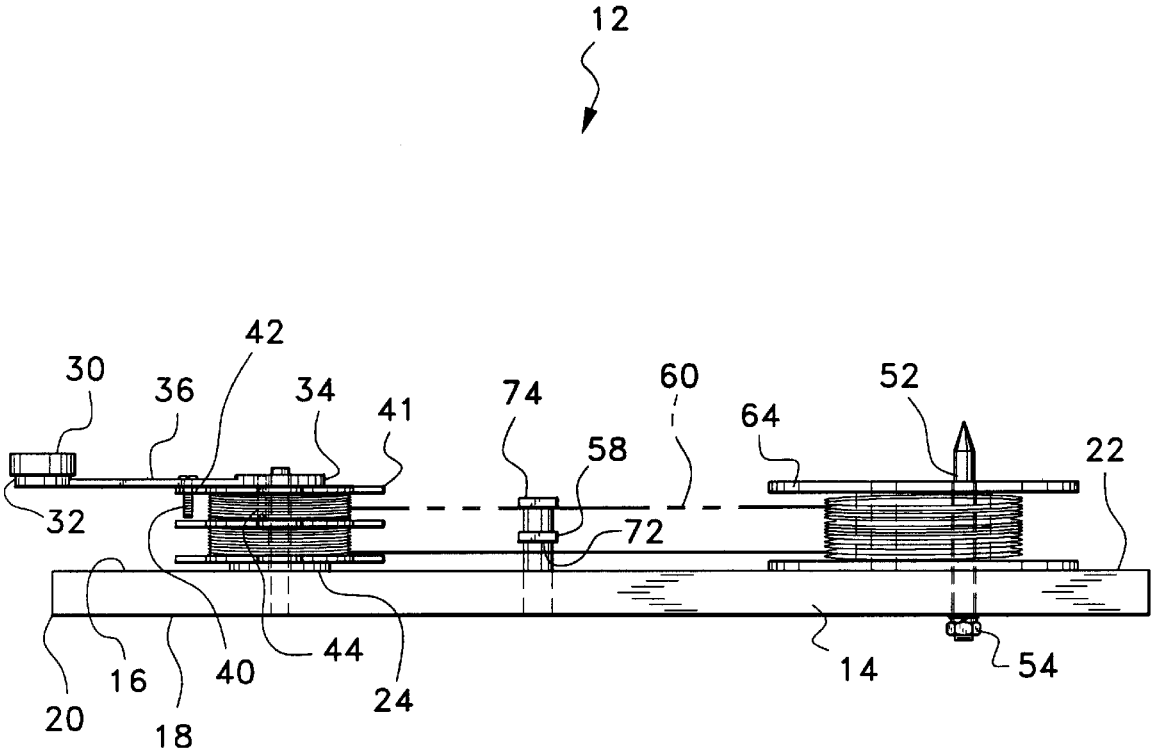
FIG. 3 is a side view of an alternate embodiment of the line rewinding device for use with gas powered weed trimmers.
Figure 4:
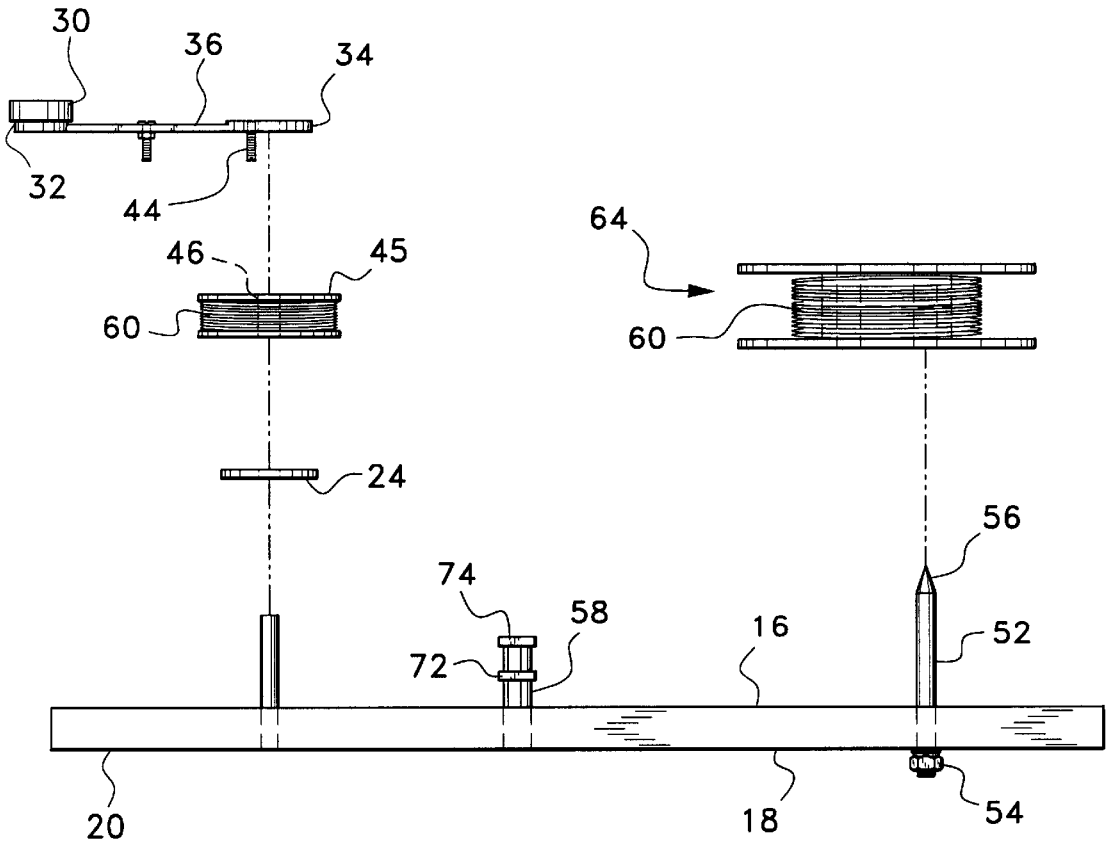
FIG. 4 is an exploded side view of an electric powered weed trimmer line rewinder device.
Figure 5:
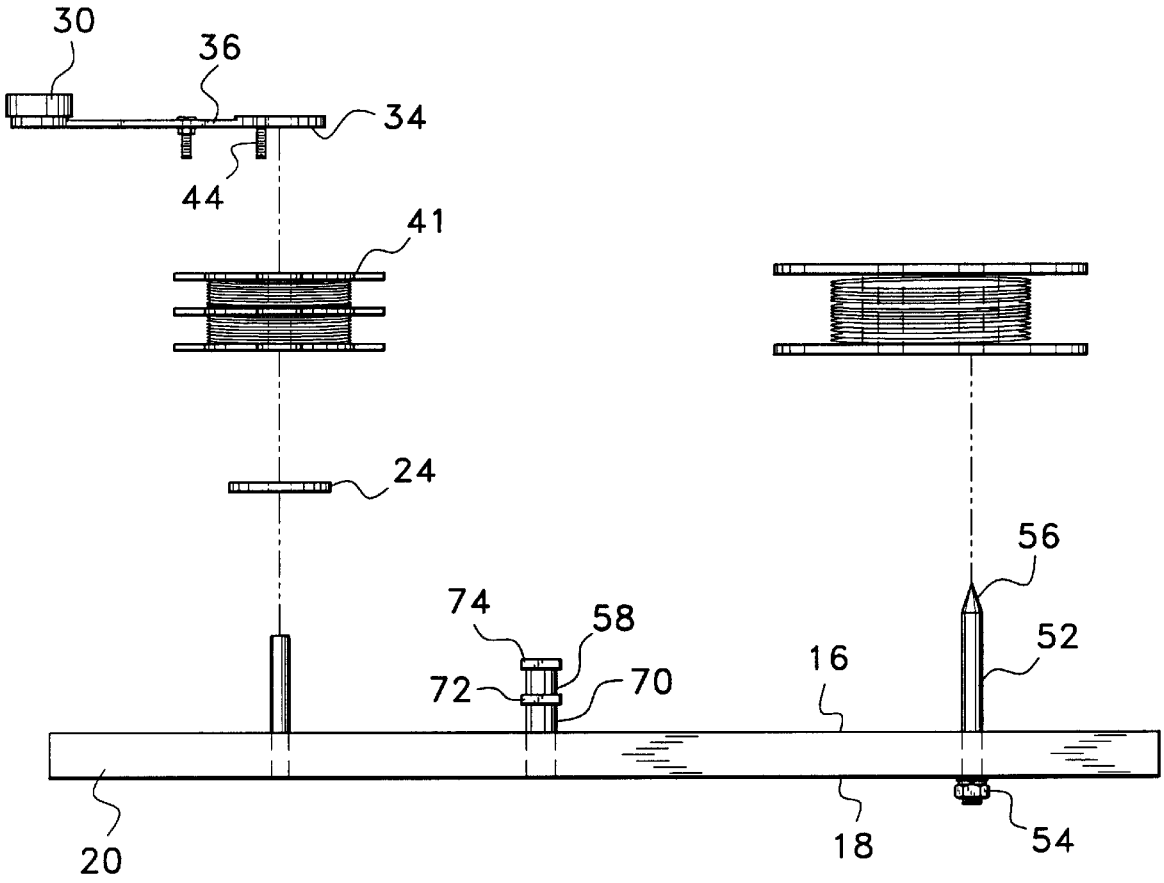
FIG. 5 is an exploded side view of a gas powered weed trimmer line rewinder device.

As best shown in FIG. 3, outside lug key 40 engages with outside lug 42 on a gas-powered weed trimmer spool 41, shown in FIGS. 3 and 5. Inside lug key 44 engages with inside lug 46 on an electric-powered weed trimmer spool 45, shown in FIGS. 1, 2 and 4.

A cylindrical, vertically oriented weed trimmer spool pin 50 is affixed to base board 14 and extends through the axis of rotation of second end 34 of crank 28 and through the center of lubricant disc 24.

A vertically oriented filler spool axle 52 has a bottom end 54 affixed to base board 14 proximate the right end 22, and a sharpened top end 56 (FIGS. 1 through 5). The purpose of having a sharpened top end 56 is to have the capacity to poke through the plastic wrap 66 (FIG. 1) in which filler spool 64 is conventionally wrapped.

An F-shaped guide peg 58 is affixed to base board 14 at a location approximately midway between weed trimmer spools 41, 45 and filler spool 64. Peg 58 has a vertical segment 70, a lower horizontal shelf 72, and an upper horizontal shelf 74. String 60 is vertically restrained and guided by either of shelf 72 or shelf 74 depending, again, upon the size and type of weed trimmer spool. Vertical segment 70 of peg 58, on the other hand, provides horizontal guidance and imparts tension upon string 60 as it is wound.

In operation, as knob 30 is rotated by hand, weighted second end 34 of crank 28 simply rests on a weed trimmer spool 45 as the lug key 390 engages the inside lug 46 to wind string 60 onto spool 41 or 45 from filler spool 64.

It is to be understood that the present invention is not limited to the sole embodiments described above, but encompasses any and all embodiments within the scope of the following claims.

We claim:

1. A weed trimmer line rewinder device, comprising:

a horizontally planar base board having a top surface, a bottom surface, a left end, and a right end;

a solid lubricant disc horizontally affixed to a portion of said top surface proximate said left end;

a weed trimmer spool centered and seated upon, and overhanging said lubricant disc;

a horizontally disposed hand crank having a finger knob on the upper side of a first end, a weighted second end about which said crank is rotatable, and a crank shaft connecting said first end to said second end, said shaft having a flat lower side from which extends at least one lug key;

a cylindrical, vertically oriented weed trimmer spool pin affixed to said base board and extending through the axis of rotation of said second end of said crank and through the center of said solid lubricant disc;

a vertically oriented filler spool axle having a bottom end affixed to said base board proximate said right end of said base board; and an F-shaped guide peg affixed to said base board at a location approximately midway between said weed trimmer spool and said filler spool, said peg having a vertical segment, a lower horizontal shelf, and an upper horizontal shelf.

2. The device according to claim 1, wherein the solid lubricant is graphite.

3. The device according to claim 1, wherein the solid lubricant is plastic.

4. The device according to claim 3, wherein the plastic is Teflon.

5. The device according to claim 1, wherein the solid lubricant is glued to the top surface of the base board.

6. The device according to claim 1, wherein the device is adapted for winding a spool for a grass trimmer powered by electricity.

7. The device according to claim 1, wherein said at least one lug key comprises an inside lug key depending from the lower side of said crankshaft, the inside lug key being adapted for engaging an inner lug in a spool for a grass trimmer powered by electricity.

8. The device according to claim 1, wherein the device is adapted for winding a spool for a grass trimmer powered by gas.

9. The device according to claim 1, wherein said at least one lug key comprises an outside lug key depending from the lower side of said crankshaft, the outside lug key being adapted for engaging an outer lug on a spool for a grass trimmer powered by gas.

10. The device according to claim 1, wherein the filler spool axle has a sharpened top end for poking through plastic in which the filler spool is wrapped.

* * * * *